United States Patent [19]

Stahlecker

[11] Patent Number: 4,612,762

[45] Date of Patent: Sep. 23, 1986

[54] CLEANING ARRANGEMENT FOR OPEN-END FRICTION SPINNING MACHINES

[75] Inventor: Fritz Stahlecker, Bad Überkingen, Fed. Rep. of Germany

[73] Assignee: Hans Stahlecker and Fritz Stahlecker, Fed. Rep. of Germany

[21] Appl. No.: 662,557

[22] Filed: Oct. 19, 1984

[30] Foreign Application Priority Data

Oct. 28, 1983 [DE] Fed. Rep. of Germany ..... 3339129

[51] Int. Cl.[4] ..... D01H 7/885; D01H 1/135

[52] U.S. Cl. ..... 57/301; 57/401

[58] Field of Search ..... 57/301, 302, 400, 401

[56] References Cited

U.S. PATENT DOCUMENTS

| | | | |
|---|---|---|---|
| 3,524,312 | 8/1970 | Landwehrkamp et al. | 57/302 |
| 3,597,911 | 8/1971 | Schiltknecht | 57/302 |
| 4,380892 | 4/1983 | Parker et al. | 57/401 |
| 4,514,972 | 5/1985 | Stahlecker | 57/401 X |
| 4,514,973 | 5/1985 | Stahlecker | 57/301 |

*Primary Examiner*—John Petrakes

*Attorney, Agent, or Firm*—Barnes & Thornburg

[57] ABSTRACT

A method and apparatus for the cleaning of a spinning unit of an open-end friction spinning machine is disclosed for spinning units of the type containing two rollers arranged next to one another, drivable in the same rotational direction and forming a wedge-shaped yarn forming gap. It is provided according to the invention that a device for carrying out the cleaning is applied to the area of the wedge-shaped gap and that, during the cleaning, the yarn and fiber holding forces directed to the wedge-shaped gap during the spinning operation are eliminated or at least reduced. Preferred disclosed embodiments reduce the yarn and fiber holding forces during cleaning by reducing or interrupting the suction forces and by stopping or reversing the rotation of at least one of the friction rollers.

13 Claims, 3 Drawing Figures

N
M
56
55
57
54
16
15
10
17
52
18
8
1
15
11
27
53
L
K
19
48
44
46
29
33
G
F
50
32
C
B
41
40
39
36
37
38
35
34
30
43
42
26
25
20
E
D
24
21
23
22
13

CLEANING ARRANGEMENT FOR OPEN-END FRICTION SPINNING MACHINES

BACKGROUND AND SUMMARY OF THE INVENTION

This invention relates to a process and a device for cleaning a spinning unit of an open-end friction spinning machine of the type having spinning units containing in each case two friction rollers that are drivable in the same rotational direction and are arranged next to one another to form a wedge-shaped gap serving as the yarn forming point or region. During the normal spinning operation, fed fibers and a forming yarn are maintained in the wedge-shaped gap by forces produced by at least one suction device acting at the wedge-shaped gap and by the friction of the rollers.

Within the spinning unit of the open-end friction spinning machine, deposits of flying fiber material, fiber residues, fiber dust and similar substances may be made which are contained in the fed fiber material and the fiber material to be processed. In particular, such deposits may adhere to the cover or shell surfaces of the friction rollers. Especially in the case of a yarn breakage when the forming yarn can no longer be withdrawn, despite the stopping of the feeding device after the yarn breakage, single fibers are continued to be fed by the feeding and opening device which are deposited in the wedge-shaped gap and remain there. As a result, a piecing process for eliminating the yarn breakage may be impaired. It is therefore necessary, from time to time and especially after a yarn breakage, to clean the spinning unit, especially in the area of the friction rollers. In order to be able to clean the rollers, it is disclosed in European Published Unexamined Patent Application (EP-OS) 52 412 to support the rollers independently from one another in such a way that one roller can be moved away from the other roller. Thereafter a manual cleaning can take place. Such a cleaning process is awkward and is difficult to carry out, especially by an automatic cleaning device. In addition, it is disadvantageous with respect to achieving an error free spinning result to arrange one of the two rollers in a movable bearing because then the narrow distance between the rollers can be maintained precisely only at considerable expenditure.

The invention is based, at least in part, on the objective of providing a process and a device of the above-mentioned type which is suitable for an automated working process and by means of which the rollers, especially in the area of the wedge-shaped gap, can be subjected to a reliable cleaning.

This objective is achieved according to the invention by providing that in the area of the wedge-shaped gap, a device for carrying out the cleaning process is applied, and that during the cleaning the yarn and fiber holding forces aimed into the wedge-shaped gap during normal spinning operation are removed or at least partially reduced. Especially by the removal or at least by the reduction of the forces acting at the wedge-shaped gap, dirt and especially also fiber residues can be removed from the area of the wedge-shaped gap in a simple manner.

According to certain preferred embodiments of the invention, it is provided that at least the roller rotating into the wedge-shaped gap during normal spinning operations is stopped during the cleaning. As a result, the conveying effect of this roller is interrupted so that fibers or fiber residues existing in the wedge-shaped gap can be carried out of the wedge-shaped gap by the second roller to the extent it continues ro run, so that these fibers or fiber residues can be grasped and carried away easily by a cleaning device. An especially advantageous embodiment of the invention provides that the roller rotating into the wedge-shaped gap during the spinning operation is, during the cleaning, rotated at least temporarily against its normal spinning operational rotating direction. This has the result that residues located in the wedge-shaped gap are at least moved slightly out of the wedge-shaped gap, since both rollers now rotate out of the wedge-shaped gap. The residues are therefore not jammed into the wedge-shaped gap. The residues are therefore not jammed into the wedge-shaped gap so that they can be removed relatively easily.

According to a further aspect of certain preferred embodiments of the invention, it is provided that during the cleaning, the effect of the suction device is turned off or at least reduced. This also at least reduces the forces affecting the dirt and residues in the area of the wedge-shaped gap, so that the removal of this dirt and these residues is simplified.

According to a further aspect of certain preferred embodiments of the invention, it is provided that the area of the wedge-shaped gap is sucked off (vacuum cleaned) and/or brushed off from the outside. This ensures a reliable cleaning of the rollers, during which parts adhering to the rollers are also removed. In this case, is especially advantageous if one or both rollers during the cleaning is/are driven with an alternating rotating direction.

In certain preferred embodiments of the invention, a device for the cleaning of a spinning unit is provided where a maintenance of servicing apparatus is provided that can be moved along the open-end friction spinning machine and can be applied to a spinning unit. The servicing apparatus contains a cleaning device that can be applied to the area of the wedge-shaped gap of the rollers of this spinning unit, and is equipped with means for removing or at least reducing the yarn and fiber holding forces acting at the wedge-shaped gap during the normal spinning operation. This servicing apparatus which, in particular can also contain the means required for an automatic piecing process after a yarn breakage, carries out the cleaning process without having to rely on the care of the operating personnel, especially removing reliably the residues or dirt located in the area of the wedge-shaped gap.

Further objects, features, and advantages of the present invention will become more apparent from the following description when taken with the accompanying drawings which show, for purposes of illustration only, embodiments in accordance with the present invention.

DETAILED DESCRIPTION OF THE DRAWINGS

Figure 1:
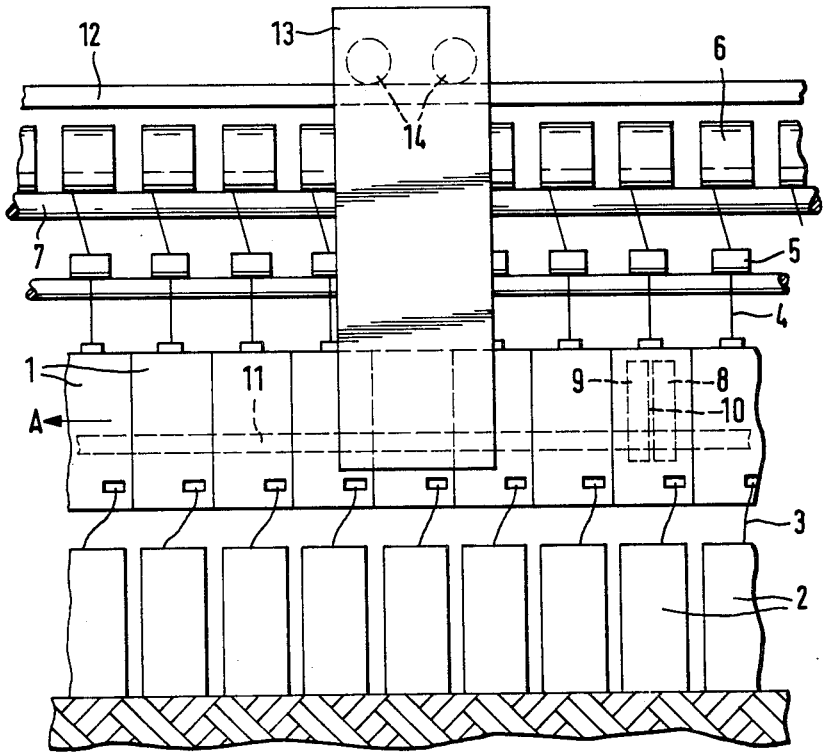
FIG. 1 is a partial front schematic view of an open-end friction spinning machine having a large number of spinning units and a movable servicing apparatus constructed in accordance with a preferred embodiment of the invention.

The open-end friction spinning machine according to FIG. 1 has a large number of spinning units 1 that are similar to one another and are arranged next to one another. A sliver 3 to be spun is fed to each spinning unit 1 from a sliver can 2, the sliver 3 being spun into a yarn 4 in the spinning unit 1. The yarn 4 is withdrawn via a withdrawal device 5 and fed to a wind-up spool 6 which is driven by a driving roller 7.

Each spinning unit 1 contains two friction rollers 8 and 9 that are arranged next to one another and together form a wedge-shaped gap 10 serving as the yarn forming region or point. The wedge-shaped gap 10 is fed with the fiber material separated into individual fibers. The rollers 8 and 9 of all spinning units 1 are jointly or commonly driven by a tangential belt 11 running in the direction of the arrow A in the longitudinal direction of the open-end friction spinning machine. The tangential belt 11 (see FIGS. 2 and 3) runs along directly against the cover or shell surfaces of the rollers 8 and 9. During the normal spinning operation, belt 11 is loaded by means of a tension roll 27 arranged in the center between the two rollers 8 and 9 and pressing the tangential belt 11 evenly against the two rollers 8 and 9. The tension roll 27 is disposed by means of a shaft 29 on a lever 30 which can be swivelled around a swivel shaft 31 extending in parallel to the rollers 8 and 9. The pressing-on of the tension roll 27 is carried out by a pressure spring 32 which rests against the lever 30 and supports itself at a counterbearing 33 attached to the machine.

Figure 2:
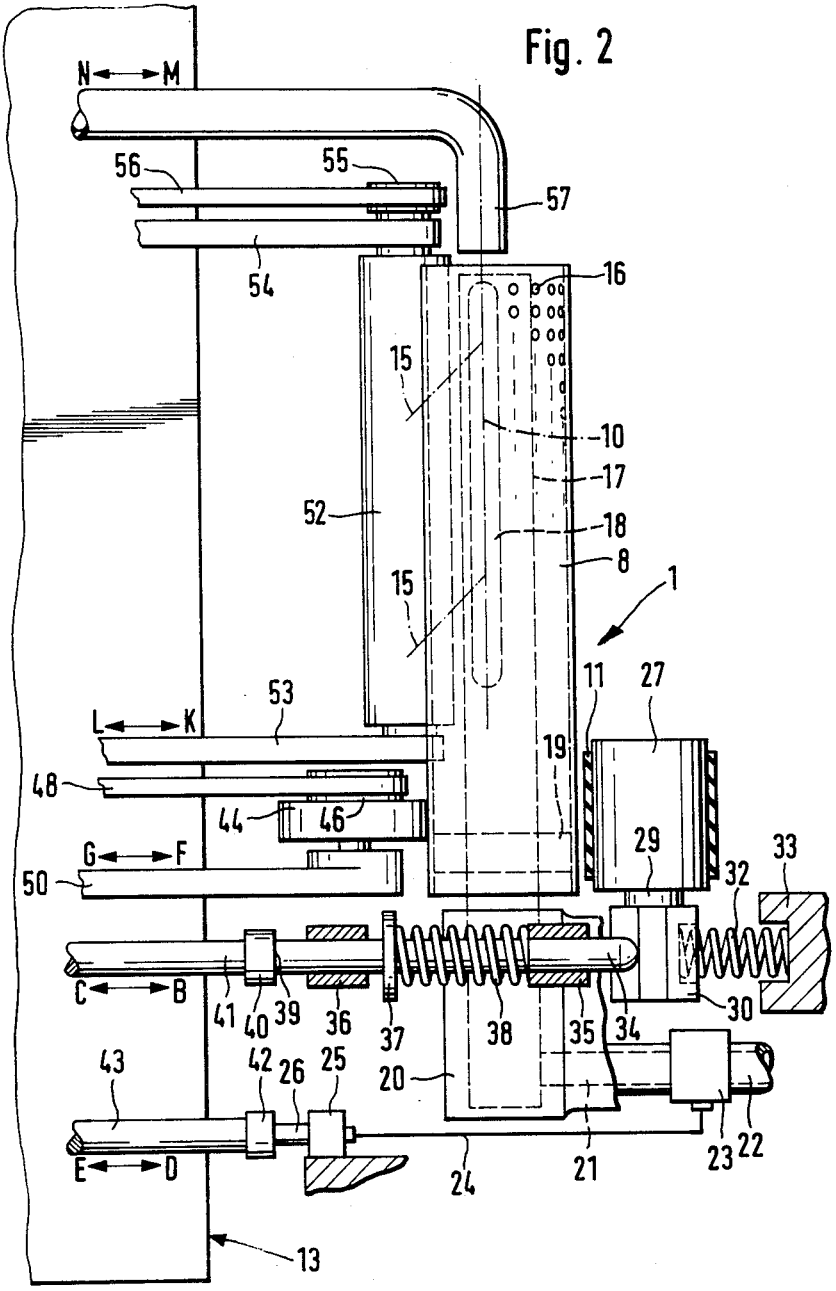
FIG. 2 is an enlarged partial vertical sectional schematic view of the open-end friction spinning machine according to FIG. 1 in the area of a spinning unit where the servicing apparatus is operating.
Figure 3:
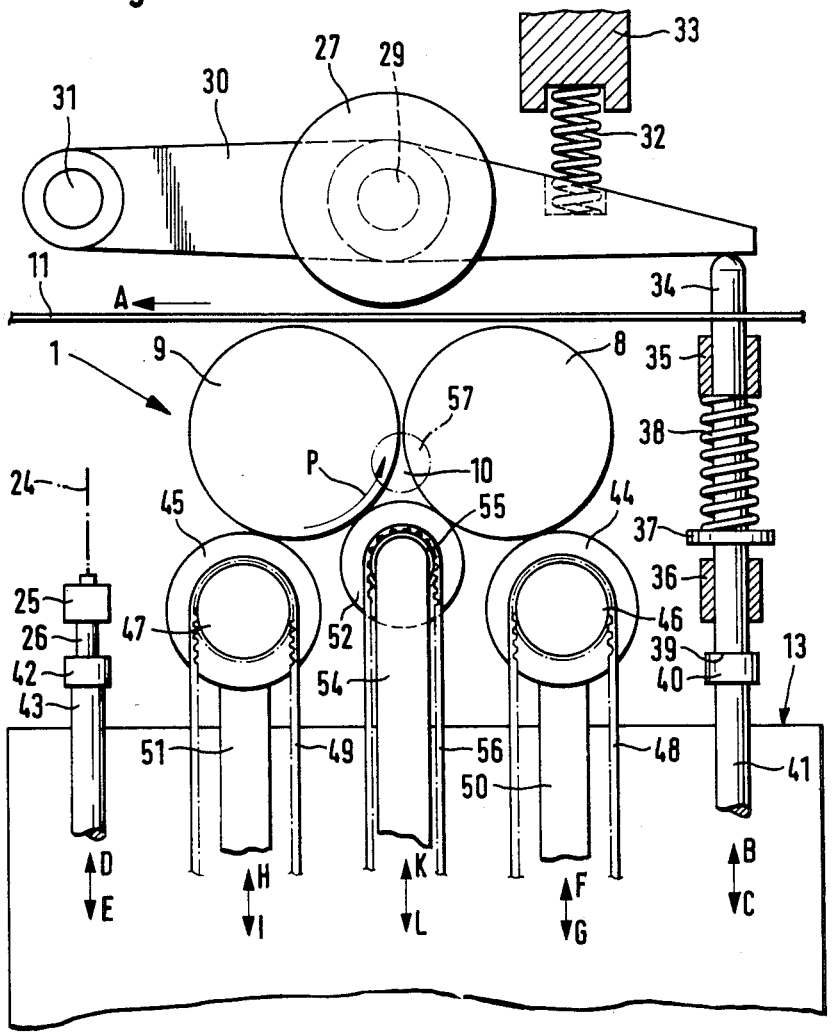
FIG. 3 is a top view of FIG. 2 where several components were left out to facilitate the illustration of the invention.

Preferably, both rollers 8 and 9 are formed as so-called suction rollers. However, it is also sufficient according to certain preferred embodiments to form only the roller 9 rotating into the wedge-shaped gap 10 (Arrow P) as a suction roller and to provide the other roller 8 with a closed shell surface, preferably having a covering. In the case of the illustrated embodiment, the shell surfaces of both rollers 8 and 9 are provided with a perforation 16 (FIG. 2). Pipe-shaped suction inserts 17 are arranged in the inside of the rollers 8 and 9, said suction inserts 17 having slot-shaped suction openings 18 delimited by webs and extending in the longitudinal direction of the wedge-shaped gap 10. Openings 18 are disposed so as to be aiming at the wedge-shaped gap 10. In this way, the wedge-shaped gap 10 is exposed to suction, by means of which, during normal spinning operation, the fibers fed via a fiber feeding channel and the forming yarn 4 are held in the wedge-shaped gap. The fiber feeding channel in FIG. 2 is depicted in its contour by dash-dotted lines 15. The tube-shaped shells of the rollers 8 and 9 are supported on the tube-shaped suction inserts or pipes 17 by means of roller bearings 19. In the case of the illustrated embodiment, an overhung bearing is provided. Further, the invention also contemplates arrangements with a second roller bearing arranged also in the area of the other end of the shell surfaces. The suction pipes 17 which are closed at their ends, protrude at least on one side out of the rollers 8 and 9. These projecting ends of pipes 17 are clamped to the machine frame by means of holders 20. A suction duct 21 leads through the holder 20 and connects the suction pipes 17 to a vacuum source that is not shown via a pipe 22. A switch-off valve or a throttle valve 23 is arranged in the duct 21 or in the suction pipe 22.

Rails are provided above the wind-up spools 6, on which a servicing apparatus 13 can be moved by means of runners (rollers) 14, where a drive is provided for at least one of the runners. The servicing apparatus 13 has the task of cleaning the rollers 8 and 9, especially after a yarn breakage. In preferred embodiments, the servicing apparatus is equipped with means for resuming a piecing process after a yarn breakage at the troubled spinning point 1. In order not to obscure the disclosure of the present invention, the means for resuming the piecing process are illustrated or described in detail herein.

In order to carry out a servicing or maintenance procedure, the servicing apparatus 13 first interrupts the drive of the rollers 8 and 9 on the machine side. For this purpose, the servicing apparatus 13 is provided with a pressure rod 41 that can be moved in the direction of the arrows B and C, said pressure rod 41 swivelling the swivel arm 30 with the tension roll 27 so that the tangential belt 11 detaches itself from the shell surfaces of the two rollers 8 and 9. When the tangential belt 11 between the individual spinning points 1 is not guided in such a way that it lifts off the rollers 8 and 9 when the tension roll 27 is moved away, a lifting roll may be provided in addition which, on the side of the rollers 8 and 9, places itself against the tangential belt 11 and lifts it. The transfer of the movement of the pressure rod 41 to the swivel arm 30 takes place via a tappet 34 provided at each spinning unit 1. The tappet 34 projects from the spinning unit 1 with a pressure surface 39 and is located opposite a thrust piece 40 of the pressure rod 41 when the servicing apparatus is in its operative position. The tappet 34 is guided in guides 35 and 36 of the spinning unit 1. Tappet 34 is normally held in the spinning operating position by means of a pressure spring 38 supporting itself on a stop 37 of the tappet 34 and the guide 35. The above-mentioned belt lifting roll may be fastened at the swivel arm 30 or at the tappet 34.

The servicing apparatus 13 is provided with another pressure rod 43 which can be moved corresponding to the arrows D and E and in the process, by means of a thrust piece 42, actuates a pusher 26 of a switch 25 fastened at the spinning unit 1 which, via an electric line 24, is connected with the electrically switchable switch-off valve or throttle valve 23.

The servicing apparatus 13 is also provided with two auxiliary drives which each contain a friction wheel 44 and 45 that can be applied to the shell surfaces of the rollers 8 and 9. The friction wheels 44 and 45 are each disposed on levers 50 and 51 which, corresponding to the arrows F, G and H, I can be applied to the rollers 8 and 9. The friction wheels 44 and 45 are connected in a rotatably stable manner with toothed wheels 46 and 47 which are driven by a toothed belt or a chain 48 or 49. The toothed belts or chains 48 and 49, run via the pinions of driving motors that are not shown, can be reversed in their rotating direction and may, if necessary, be adjusted continuously with respect to their rotating speed.

As shown especially in FIG. 2, the tangential belt 11 as well as the friction wheels 44 and 45 are arranged below the fiber-guiding area of the wedge-shaped gap 10, so that by their application, a cleaning of the rollers 8 and 9 in the area of the fiber-carrying wedge-shaped gap 10 is not impaired.

The servicing apparatus 13 is also provided with a cleaning roller 52 which is preferably equipped with bristles and developed as a brush. The cleaning roller 52 is disposed on one of two arms 53 and 54 that can be slid corresponding to the arrows K and L. Roller 52 is connected with a toothed wheel 55 in a rotatably stable manner, the toothed wheel 55 being driven by a toothed belt or a chain 56 which itself runs via a pinion of a driving motor that is not shown. In addition the servicing apparatus 13 is equipped with a suction pipe 57 that can be moved out corresponding to the directions of the arrows M and N and, on the front side, can be brought over the end of the wedge-shaped gap 10.

Before a cleaning process, the drive of the rollers 8 and 9 is interrupted as described by actuating the pressure rod 41, in which case the tension roll 27 is lifted off the tangential belt 11 and the belt 11 itself is lifted off the shell surfaces of the rollers 8 and 9. At the same time or subsequently, via the pressure rod 43, the throttling or closing of the valve 23 is triggered in the above-described manner so that the suction effect directed into the wedge-shaped gap 10 is reduced or cancelled. Subsequently, the friction wheels 44 and 45 as well as the cleaning roller 52 and the suction pipe 57 are applied to the rollers 8 and 9. At least at the start of the cleaning process, the friction wheel 45 is driven in such a way that the roller 9 rotating into the wedge-shaped gap 10 during the normal spinning operation in the direction of the arrow P is driven against this running direction. When the roller 8, by means of the friction wheel 44, is driven in the operational rotating direction, the shell surfaces of both rollers 8 and 9 move out of the wedge-shaped gap 10 so that residues of fiber or similar substances located there are no longer jammed in, but are loosened. These can then easily be sucked off via the suction pipe 57. The shell surfaces of the rollers 8 and 9 are then cleaned by the cleaning roller 52, in which case the loosened residues or dirt are sucked off via the suction pipe 57. In order to increase the effect of the cleaning roller 52, the rollers 8 and 9, may in this case be driven in alternating rotating direction via the friction wheels 44 and 45. The rotating speed in this case is much lower than the operational rotating speed of the rollers 8 and 9.

The friction wheels 44 and 45 may also be used for the subsequent piecing process, in which case, they will then drive the rollers 8 and 9, after the cleaning roller 52 and the suction pipe 57 have moved back into the servicing apparatus 13, in the normal operational rotating direction. In this case, the tangential belt 11 will remain lifted off.

Although the present invention has been described and illustrated in detail, it is to be clearly understood that the same is by way of illustration and example only and is not to be taken by way of limitation. The spirit and scope of the present invention are to be limited only by the terms of the appended claims.

What is claimed is:

1. A method of cleaning a spinning unit of an open-end friction spinning machine of the type having spinning units which contain a pair of adjacently arranged friction rollers forming a wedge-shaped yarn forming gap therebetween, roller driving means for driving the rollers in the same rotational direction, and holding force means for applying holding forces to hold the forming yarn and supplied fibers in the wedge-shaped gap during normal spinning operations, said method comprising:

reducing the effect of the holding means at the wedge-shaped gap, and activating cleaning means to clean the area of the wedge-shaped gap while the effect of the holding force means is reduced, said holding force means including roller friction surface means and at least one suction device means, said reducing the effect of the holding force means including temporarily driving the roller which normally rotates into the wedge-shaped gap during a spinning operation so as to rotate in the opposite rotational direction.

2. A method of cleaning a spinning unit of an open-end friction spinning machine of the type having spinning units which contain a pair of adjacently arranged friction rollers forming a wedge-shaped yarn forming gap therebetween, roller driving means for driving the rollers in the same rotational direction, and holding force means for applying holding forces to hold the forming yarn and supplied fibers in the wedge-shaped gap during normal spinning operations, said method comprising:

reducing the effect of the holding means at the wedge-shaped gap, and activating cleaning means to clean the area of the wedge-shaped gap while the effect of the holding force means is reduced, said holding force means including roller friction surface means and at least one suction device means, at least one of the rollers being driven in alternating rotating directions during cleaning operations.

3. Apparatus for cleaning a spinning unit of an open-end friction spinning machine of the type having spinning units which contain a pair of adjacently arranged friction rollers forming a wedge-shaped yarn forming gap therebetween, roller driving means for driving the rollers in the same rotational direction, and holding force means for applying holding forces to hold the forming yarn and supplied fibers in the wedge-shaped gap during normal spinning operations, comprising:

a movable servicing unit that can be selectively positioned adjacent a spinning unit to be serviced, cleaning device means carried by said servicing unit which can be operatively applied to the wedge-shaped gap area of the rollers, and holding force reducing means for reducing the effect of the holding force means during cleaning operation, said holding force means including roller friction surface means and at least one suction device means, said holding force reducing means including an auxiliary drive on the servicing unit that is engageable with at least one roller, said drive being capable of driving said at least one roller in a reverse rotational direction.

4. Apparatus for cleaning a spinning unit of an open-end friction spinning machine of the type having spinning units which contain a pair of adjacently arranged friction rollers forming a wedge-shaped yarn forming gap therebetween, roller driving means for driving the rollers in the same rotational direction, and holding force means for applying holding forces to hold the forming yarn and supplied fibers in the wedge-shaped gap during normal spinning operations, comprising:

a movable servicing unit that can be selectively positioned adjacent a spinning unit to be serviced, cleaning device means carried by said servicing unit which can be operatively applied to the wedge-shaped gap area of the rollers, and holding force reducing means for reducing the effect of the holding force means during cleaning operation, said holding force means including roller friction surface means and at least one suction device means, said servicing unit being provided with an auxiliary drive which contains at least one friction wheel that can be engaged with the shell surface of at least one of the rollers, said friction wheel being connected to a driving motor, said driving motor being capable of driving said friction wheel in a reverse rotational direction.

5. A method according to claim 1, wherein said reducing the effect of the holding force means includes stopping at least the roller rotating into the wedge-shaped gap during the normal spinning operation.

6. A method according to claim 1, wherein said reducing the effect of the holding force means includes reducing the effect of the suction device means.

7. A method according to claim 1, wherein said activating of cleaning means includes applying suction forces from the outside to the wedge-shaped gap.

8. A method according to claim 1, wherein said activating of cleaning means includes activating of brush means to brush the rollers.

9. A method according to claim 2, wherein both rollers are driven in alternating rotating directions during cleaning.

10. Apparatus according to claim 3, wherein said holding force reducing means includes drive interrupting means at the servicing unit for interrupting the operational drive of a spinning unit.

11. Apparatus according to claim 3, wherein said holding force reducing means includes vacuum control means at the servicing unit for the throttling or switching-off of the suction device means of a spinning unit.

12. Apparatus according to claim 3, wherein the cleaning device means includes a suction intake pipe at the servicing unit that can be applied to the area of the wedge-shaped gap.

13. Apparatus according to claim 3, wherein the cleaning device means includes a roller-shaped cleaning element that can be applied to the area of the wedge-shaped gap between two rollers of a spinning unit.

* * * * *